US009350117B2

(12) United States Patent
Zuriarrain Berasategi

(10) Patent No.: US 9,350,117 B2
(45) Date of Patent: May 24, 2016

(54) THERMOCOUPLE AND THERMOCOUPLE CONNECTOR

(71) Applicant: ORKLI, S.COOP., Ordizia (ES)

(72) Inventor: Mikel Zuriarrain Berasategi, Lazkao (ES)

(73) Assignee: ORKLI S. COOP, Ordizia (ES)

( * ) Notice: Subject to any disclaimer, the term of this patent is extended or adjusted under 35 U.S.C. 154(b) by 103 days.

(21) Appl. No.: 14/273,486

(22) Filed: May 8, 2014

(65) Prior Publication Data

US 2014/0335718 A1 Nov. 13, 2014

(30) Foreign Application Priority Data

May 10, 2013 (EP) ..... 13382173

(51) Int. Cl.

| | |
|---|---|
| ***H01R 9/05*** | (2006.01) |
| ***H01R 13/639*** | (2006.01) |
| ***F23N 5/10*** | (2006.01) |
| ***H01R 13/18*** | (2006.01) |
| ***H01R 24/38*** | (2011.01) |
| *H01R 4/64* | (2006.01) |

(52) U.S. Cl.

CPC ..... *H01R 13/639* (2013.01); *F23N 5/107* (2013.01); *H01R 13/18* (2013.01); *H01R 24/38* (2013.01); *F23N 2900/05101* (2013.01); *H01R 4/64* (2013.01)

(58) Field of Classification Search

CPC .... H01R 24/38; H01R 24/40; H01R 2103/00; H01R 13/052

USPC ..... 439/578, 825, 353

See application file for complete search history.

(56) References Cited

U.S. PATENT DOCUMENTS

| | | | | |
|---|---|---|---|---|
| 4,750,897 | A * | 6/1988 | Neidecker | H01R 13/187 439/825 |
| 5,439,386 | A * | 8/1995 | Ellis | H01R 24/542 439/271 |
| 5,695,357 | A * | 12/1997 | Wright | H01R 4/50 29/877 |
| 5,951,337 | A * | 9/1999 | Brake | H01R 13/17 439/825 |
| 6,609,931 | B2 * | 8/2003 | Parrish | H01R 13/17 439/108 |
| 7,731,549 | B2 * | 6/2010 | Metzler | H01R 13/052 439/825 |

(Continued)

FOREIGN PATENT DOCUMENTS

| | | |
|---|---|---|
| EP | 0619460 A1 | 10/1994 |
| EP | 0619460 B1 | 6/1997 |

(Continued)

OTHER PUBLICATIONS

Extended European Search Report for EP13382173.6 issued by the European Patent Office, Rijswijk, Netherlands dated Oct. 2, 2013.

*Primary Examiner* — Hae Moon Hyeon

(57) ABSTRACT

A connector that has a phase terminal, an earth terminal and an insulating body inside which the phase terminal is housed and on the outside of which the earth terminal is coupled. According to some embodiments the insulating body has at least one opening extending axially from an end of the insulating body. The earth terminal is formed at least in part by an elastic body surrounding the insulating body extending along the opening, said elastic body being configured for being deformed against the inside of an earth terminal of a safety valve when the insulating body expands radially outwards, assuring electrical continuity between the elastic body and the earth terminal of the safety valve.

20 Claims, 5 Drawing Sheets

(56) References Cited

U.S. PATENT DOCUMENTS

| | | | | |
|---|---|---|---|---|
| 7,955,143 | B2 * | 6/2011 | Zhang | H01R 13/17 439/825 |
| 9,106,035 | B2 * | 8/2015 | Erdos | H01R 24/542 |
| 2003/0082949 | A1 | 5/2003 | Parrish et al. | |
| 2006/0024993 | A1 * | 2/2006 | Gonzalez | H01R 13/17 439/79 |
| 2013/0217245 | A1 * | 8/2013 | Bettinzoli | H01R 13/052 439/39 |
| 2014/0162495 | A1 * | 6/2014 | Pianezze | H01R 13/193 439/578 |

FOREIGN PATENT DOCUMENTS

| | | | |
|---|---|---|---|
| EP | 2182584 | A1 | 5/2010 |
| GB | 2447648 | A | 9/2008 |
| WO | 2013021340 | A1 | 2/2013 |

* cited by examiner

THERMOCOUPLE AND THERMOCOUPLE CONNECTOR

CROSS-REFERENCE TO RELATED APPLICATIONS

This application relates to and claims the benefit and priority to European Application No. 13382173.6, filed May 23, 2013.

TECHNICAL FIELD

The present invention is related to a thermocouple connector adapted for being connected to a gas safety valve and a thermocouple comprising said connector.

BACKGROUND

Different types of quick connectors through which a thermocouple is electrically connected to a gas safety valve, particularly to an electromagnetic valve, are known in the art. It is therefore assured that in the absence of a flame in a burner, the thermocouple associated with said burner will cool down, and the electromagnetic valve will therefore no longer be energized, said electromagnetic valve closing the passage of gas towards the burner.

EP619460A1 discloses a quick connector comprising a cylindrical insulating body inside which there is housed a female terminal connected to a phase conductor of the thermocouple and a metallic sheath externally surrounding the insulating body and establishing electrical continuity with an earth conductor of the thermocouple. The female terminal is adapted for being coupled to a male phase terminal of the electromagnetic valve. The electromagnetic valve comprises a collar-like earth terminal, such that when the quick connector is coupled to the electromagnetic valve, the insulating body and the phase terminal are housed inside the collar whereas the metallic sheath is externally coupled to the collar establishing electrical continuity between the earth terminal of the connector and the collar-like earth terminal.

EP2182584A1 discloses a connector for a coaxial thermocouple comprising a phase terminal which is fixed to an end of the phase conductor of the thermocouple, an earth terminal which is fixed at one end to the earth conductor surrounding the phase terminal, and an insulating member inside which the phase terminal is fixed. The earth terminal has a substantially cylindrical geometry with an end that is fitted concentrically to the outside of the earth conductor. The earth terminal is adapted for being externally coupled to the earth terminal of the electromagnetic valve. In turn, the insulating body includes equidistantly arranged axial slots at one end which make the insulating body more flexible to make it easier to insert it into the electromagnetic valve.

SUMMARY OF THE DISCLOSURE

The object of the invention is to provide a thermocouple connector adapted for the electrical connection of a thermocouple comprising a phase conductor and an earth conductor to a gas safety valve comprising a phase terminal and an earth terminal, as defined in the claims.

According to some embodiments, the thermocouple connector comprises a phase terminal attachable to the phase conductor of the thermocouple and connectable to the phase terminal of the gas safety valve, an earth terminal attachable to the earth conductor of the thermocouple and connectable to the earth terminal of the gas safety valve, and an insulating body inside which the phase terminal of the connector is arranged housed and on the outside of which the earth terminal of the connector is arranged coupled. The insulating body comprises at least one opening extending axially along an end of said insulating body.

The earth terminal comprises an elastic body perimetrally surrounding the insulating body. The elastic body is adapted for being deformed against the inside of the earth terminal of the safety valve as the end of the insulating body expands radially when the thermocouple connector is connected to the safety valve.

Good electrical contact between the thermocouple connector and the safety valve, particularly between the earth terminal of the thermocouple connector and the earth terminal of the safety valve, is thus assured.

Furthermore, concentricity between the earth terminal and the insulating body with respect to other known thermocouple connectors is improved, problems derived from a poor electrical connection caused by said reason therefore being eliminated.

Once the elastic body is inserted into the safety valve, the pressure exerted by the elastic body together with the insulating body against the inner surface of the earth terminal of the valve keeps the thermocouple connector coupled to the safety valve, preventing accidental disassembly. Furthermore, once inserted, even if one of the conductors of the thermocouple bends externally, the phase and earth terminals of the connector continue to maintain a good electrical connection with the terminals of the safety valve.

Finally, the obtained thermocouple connector is a compact and ergonomic connector, minimal effort from the user being needed to connect said connector to the gas safety valve.

These and other advantages and features will become evident in view of the drawings and the detailed description of the invention.

DETAILED DESCRIPTION

Figure 1:
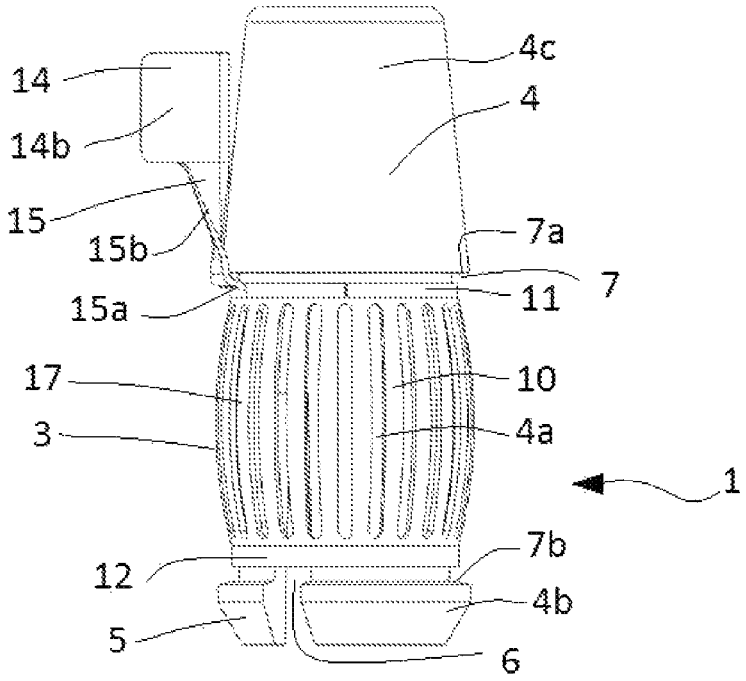
FIG. 1 shows a side view of a thermocouple connector according to one embodiment.
Figure 2:
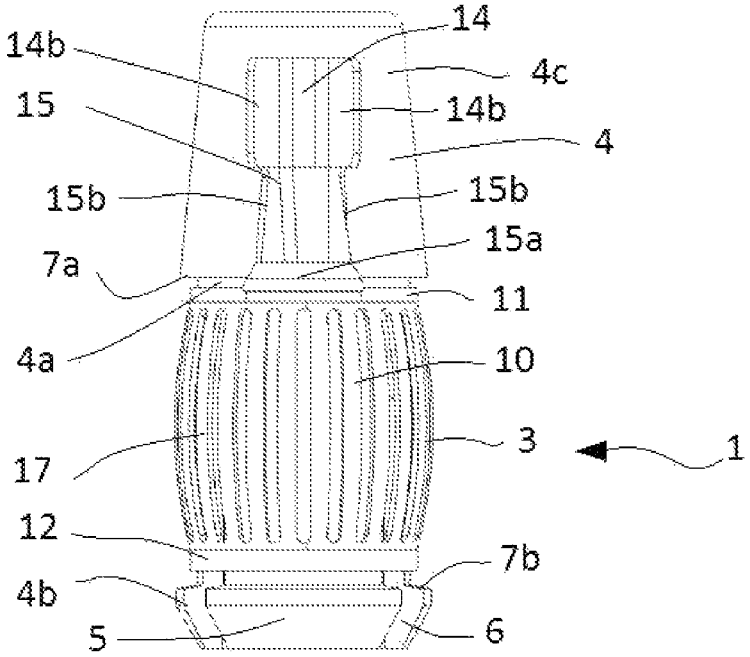
FIG. 2 is another side view of the thermocouple connector shown in FIG. 1.

FIGS. 1 to 6 show a thermocouple connector 1 according to one embodiment. The thermocouple connector 1 is adapted for electrically connecting a thermocouple 20, partially depicted in FIGS. 5 and 6, to a gas safety valve 30, partially depicted in FIGS. 5 and 6.

The thermocouple 20 comprises a phase conductor 21 and an earth conductor 22, and the gas safety valve 30 in turn comprises a phase terminal 31 and an earth terminal 32.

The thermocouple connector 1 comprises a phase terminal 2, an earth terminal 3, both terminals 2 and 3 being electrically conductive, and an insulating body 4 inside which the phase terminal 2 is arranged housed and on the outside of which the earth terminal 3 of the connector 1 is arranged coupled. The phase conductor 21 of the thermocouple 20 is fixed to the phase terminal 2 of the connector 1 which, in turn, is adapted for being connected to the phase terminal 31 of the safety valve 30. On the other hand, the earth conductor 22 of the thermocouple 20 is fixed to the earth terminal 3 of the connector 1 which, in turn, is adapted for being connected to the earth terminal 32 of the safety valve 30.

The gas safety valve 30 is an electromagnetic valve known in the state of the art so it will not be described in detail. The earth terminal 32 of the safety valve 30 may have a substantially cylindrical, collar-like, geometry. Further, both terminals 31 and 32 of the safety valve 30 being arranged substantially concentric to one another.

Figure 5:
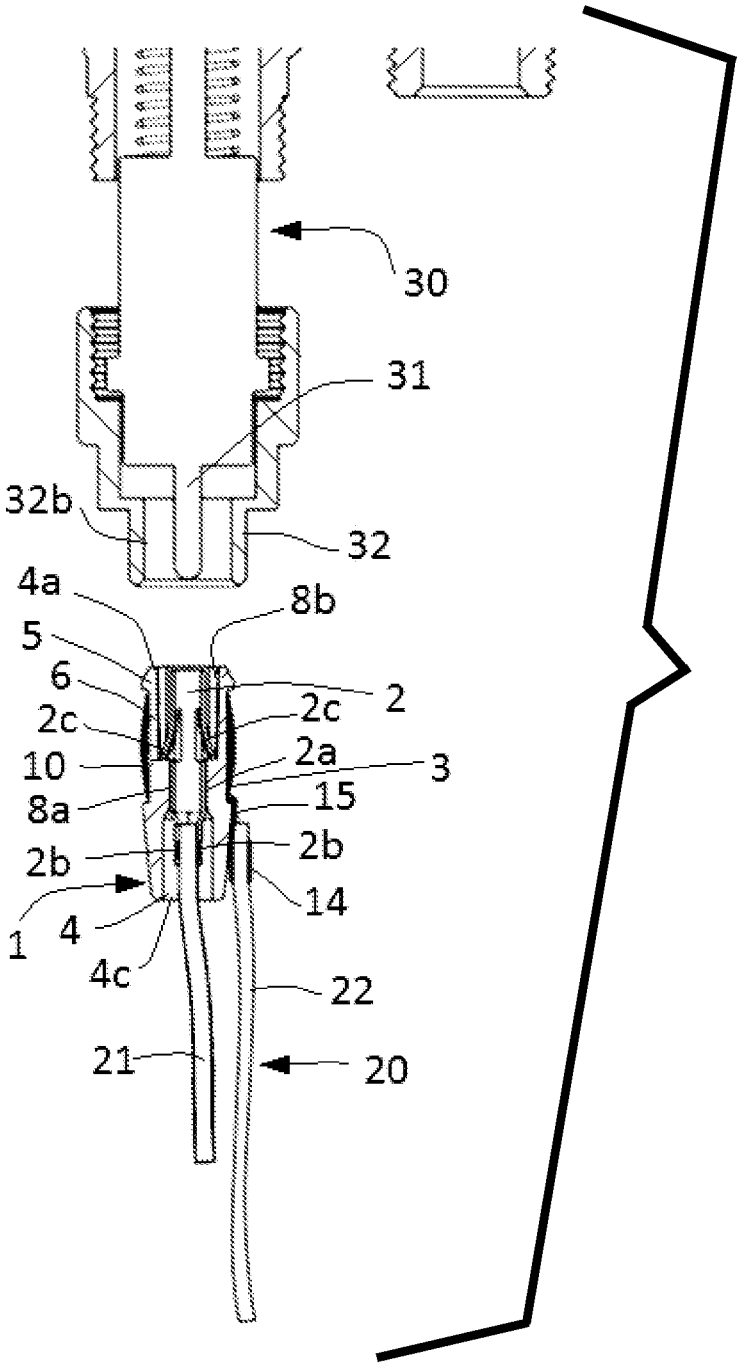
FIG. 5 shows, in exploded form, a longitudinal section of the connector shown in FIG. 1 before being connected to an electromagnetic gas valve.
Figure 6:
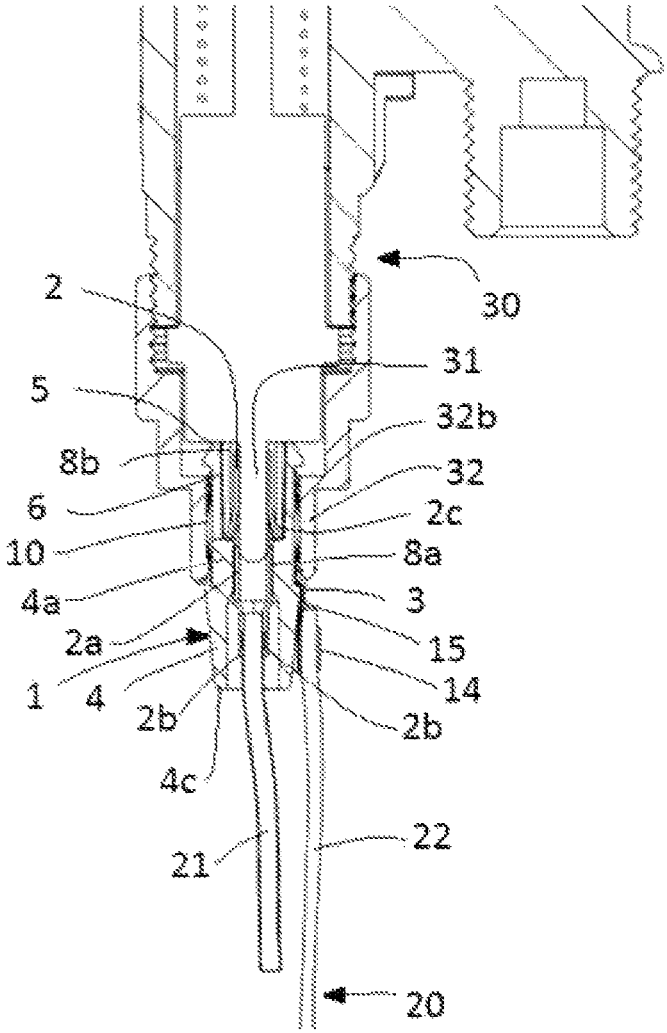
FIG. 6 shows a longitudinal section of the connector shown in FIG. 1 connected to the electromagnetic gas valve.

The phase terminal 2 of the connector 1 is a female terminal known in the state of the art. Said phase terminal 2 is substantially cylindrical and comprises an end having a substantially V-shaped cross-section defined by surfaces 2*b*, the longitudinal section of which is shown in FIGS. 5 and 6, adapted for being collapsed, trapping the phase conductor 21 of the thermocouple 20 between said surfaces 2*b*. The phase terminal 2 further comprises tabs 2*c* extending from a cylindrical surface 2*a* of the phase terminal 2 forming an angle with respect to said cylindrical surface 2*a*. The tabs 2*c* are configured for keeping the phase terminal 2 inside the insulating body 4.

The insulating body 4 electrically insulates the phase terminal 2 from the earth terminal 3 and comprises a first substantially cylindrical part 4*a* and a second substantially conical part 4*c* following the first part 4*a*. The insulating body 4 further comprises a housing 8 for the phase terminal 2. The housing 8 is substantially cylindrical and axially traverses said insulating body 4, the housing 8 comprising a first part 8*a* and a second part 8*b* following said first part 8*a* and having a diameter greater than that of the first part 8*a*. The phase terminal 2 is tightly introduced in the insulating body 4 through the first part 8*a* until the tabs 2*c* overtakes the first part 8*a*, being housed in the second part 8*b* of the housing 8, such that as said tabs 2*c* expand radially, they act like a stop, preventing accidental disassembly of the phase terminal 2 with respect to the insulating body 4 in the direction opposite the insertion of said phase terminal 2 into the insulating body 4. The first part 8*a* has dimensions adapted for keeping the phase terminal 2 coupled to the insulating body 4.

Figure 4:
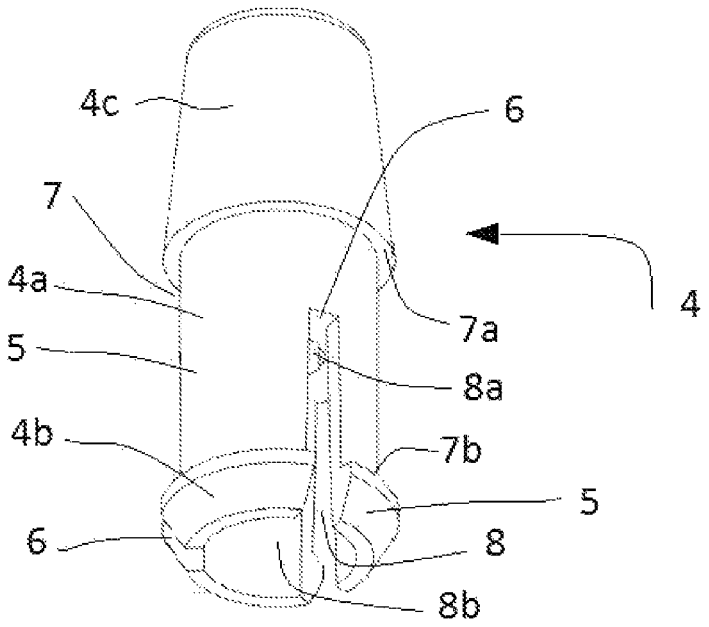
FIG. 4 shows a perspective view of the insulating member comprised in the thermocouple connector shown in FIG. 1.

The insulating body 4 comprises at least one opening 6, shown in FIG. 4, extending axially from an end 4*b* of said insulating body 4, allowing the insulating body 4 to expand radially when the phase terminal 2 of the connector 1 is coupled to the phase terminal 31 of the safety valve 30. The opening 6 extends axially along the second part 8*b* of the housing 8. In the embodiment shown in the drawings, the insulating body 4 comprises a plurality of openings 6 extending axially from the end 4*b*, along the second part 8*b* of the housing 8 and defining flanges 5 adapted for expanding radially. According to some embodiments the openings 6 are equidistantly and homogenously arranged distributed along the surface of the insulating body 4, particularly along the first part 4*a* of the insulating body 4.

On the other hand, the earth terminal 3 comprises an elastic body 10 adapted for perimetrally surrounding the insulating body 4, said elastic body 10 extending along the openings 6, the elastic body 10 being configured for being deformed against the inside of the earth terminal 32 of the safety valve 30, particularly against the inner surface 32*b* of the collar 32 when the insulating body 4 expands radially outwards. The electrical contact between the earth terminal 3 of the connector 1 and the earth terminal 32 of the safety valve 30 is thereby improved, good electrical contact being assured at all times. Furthermore, once the elastic body 10 is inserted into the collar 32 of the safety valve 30, the pressure exerted by the elastic body 10 together with the insulating body 4 against the inner surface 32*b* of the collar 32 keeps the thermocouple connector 1 coupled to the safety valve 30 in the position shown in FIG. 6, so that accidental disassembly is prevented.

The insulating body 4 further comprises a recess 7 on its outer surface, the earth terminal 3 being coupled to the elastic body 10 in said recess 7. Said recess 7 is a substantially cylindrical recess extending over the first part 4*a* of the insulating body 4 and therefore, over the openings 6. The elastic body 10 comprises ends 11 and 12, shown in FIGS. 1 to 4, adapted for coupling the earth terminal 3 in said recess 7. The recess 7 is demarcated by substantially ring-shaped stop surfaces 7*a* and 7*b* working as stops for the axial movement of the elastic body 10 with respect to the insulating body 4. Good concentricity between the earth terminal 3 and the insulating body 4 is obtained, the problem of the lack of concentricity that occurred in known connectors, when the earth terminal became deformed with use, thereby being eliminated. The good concentricity obtained makes it easier to connect the thermocouple connector 1 to the safety valve 30.

The elastic body 10 comprises at least one elastic band 17 extending longitudinally between both ends 11 and 12 of the elastic body 10.

In the embodiments shown in the drawings, the elastic body 10 is barrel-shaped. Said elastic body 10 comprises a plurality of elastic bands 17 extending longitudinally between both ends 11 and 12 of the elastic body 10, separated from one another. The elastic body 10 is coupled to the insulating body 4 only through the ends 11 and 12. Both ends 11 and 12 have a substantially cylindrical geometry. Said elastic bands 17 enable a more robust electrical connection because each elastic band 17 establishes its own electrical contact against the inner surface 32*b* of the earth terminal 32 of the safety valve 30.

Figure 3:
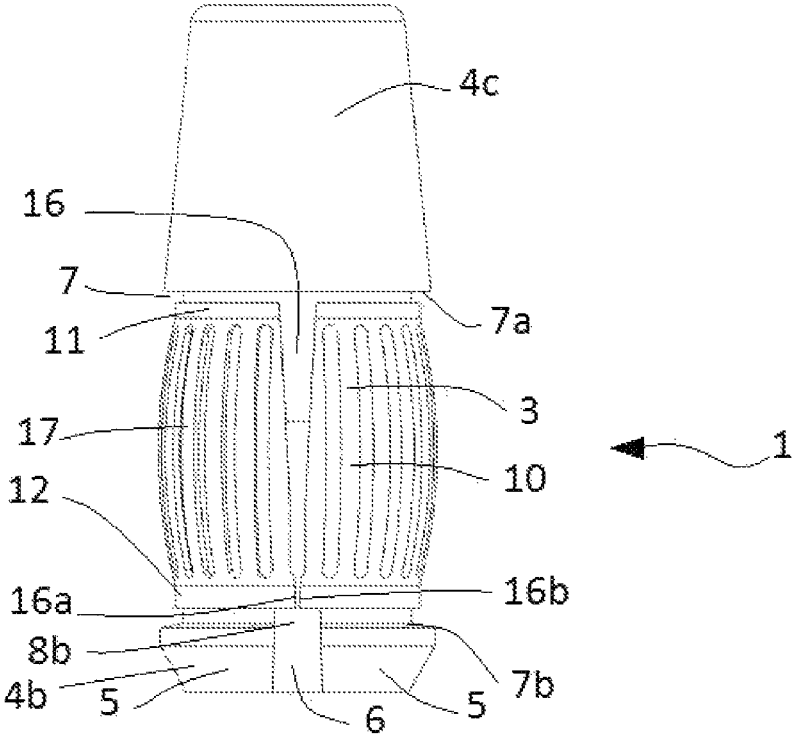
FIG. 3 is another side view of the thermocouple connector shown in FIG. 1.

The elastic body 10 comprises an opening 16, shown in FIG. 3, extending axially along the elastic body 10 and allowing said elastic body 10 to expand radially to make it easier to couple said elastic body 10 to the insulating body 4. The opening 16 extends between both ends 11 and 12. Said opening 16 further has a substantially V-shaped geometric shape between both ends 11 and 12, as shown in FIG. 3. It is therefore assured that when the connector 1 is coupled to the safety valve 30, the elastic body 10 contracts at most until the facing surfaces 16*a* and 16*b* corresponding to the vertex of the opening 16 come into contact, thereby preventing said elastic body 10 from contracting the flanges 5 of the insulating body 4.

The earth terminal 3 further comprises an end 14 having a substantially U-shaped cross-section defined by surfaces 14*b* adapted for being collapsed, trapping the earth conductor 22 of the thermocouple 20 between said surfaces 14*b*. The end 14 of the earth terminal 3 is arranged such that it is attached following the elastic body 10, particularly following an end 11 of the elastic body 10, by means of an arm 15 having a first part 15*b* with a substantially U-shaped cross-section defined by surfaces that make the earth terminal 3 more robust and a second part 15*a* attaching the first part 15*b* to the end 11 of the elastic body 10.

Finally, the insulating body 4 is made of an electrically insulating material, preferably a plastic material. In turn, the phase terminal 2 and the earth terminal 3 are made of electrically conductive materials, preferably metallic materials.

The thermocouple connector 1 according to the invention is more compact than those known in the state of the art, more ergonomic, particularly as a result of the substantially conical geometry of the second part 4*c* of the insulating body 4, which allows better gripping for the user.

As shown in FIG. 6, when the connector 1 is arranged coupled to the safety valve 30, the phase terminal 2 and the earth terminal 3 of said connector 1 are housed inside the safety valve 30, the electrical connections between the respective terminals being protected against external dirt and/or other adverse external conditions.

Furthermore, when the connector 1 is correctly assembled to the safety valve 30, the elastic body 10 may be housed entirely inside the earth terminal 32 of the safety valve 30, so a user can visually see if said connector 1 is correctly connected to the safety valve 30.

To couple the connector 1 to the safety valve 30, the user axially introduces said connector 1 inside the safety valve 30 without the user needing to apply any significant effort. Once the phase terminals 2 and 31 of the connector 1 and of the safety valve 30 are connected, the flanges 5 of the insulating body 4 open up, expanding radially, the earth terminal 3 of the connector 1, particularly the elastic body 10, pushing radially against the inner surface 32*b* of the earth terminal 32 of the safety valve 30, the plurality of elastic bands 17 being deformed against said inner surface 32*b* to assure the electrical contact between both along the larger surface.

What is claimed is:

1. A connector for electrically connecting a phase conductor of a thermocouple to a phase terminal of a gas safety valve and an earth conductor of the thermocouple to an earth terminal of the gas safety valve, the connector comprising: an insulating body that electrically isolates a first terminal from a second terminal, the first terminal attachable to the phase conductor of the thermocouple and to the phase terminal of the gas safety valve, the second terminal attachable to the earth conductor of the thermocouple and to the earth terminal of the gas safety valve, the insulating body having a housing wherein which the first terminal is at least partially housed, the housing being defined at least in part by one or more flanges that are adapted to expand radially when the first terminal is coupled with the phase terminal of the gas safety valve, extending from a first end of the insulating body are two or more axial openings that at least partially define the one or more flanges, the second terminal comprising an elastic body that at least substantially circumscribes the housing and extends along at least a length of the two or more axial openings, the second terminal configured for being deformed against an inside of the earth terminal of the gas safety valve when the one or more flanges expand radially during the first terminal being coupled with the phase terminal of the gas safety valve.

2. The connector according to claim 1, wherein the elastic body of the second terminal comprises a first axial end and a second axial end, the elastic body being coupled to the insulating body only at one or both of the first and second axial ends.

3. The connector according to claim 2, wherein at least one of the first and second axial ends of the elastic body is disposed within a recess in the insulating body.

4. The connector according to claim 1, wherein the elastic body of the second terminal comprises a first axial end and a second axial end with at least one of the first and second axial ends being disposed within a recess in the insulating body.

5. The connector according to claim 1, wherein the elastic body of the second terminal is barrel-shaped.

6. The connector according to claim 1, wherein the elastic body comprises a plurality of elastic bands that extend between first and second axial ends of the second terminal.

7. The connector according to claim 1, wherein the elastic body of the second terminal comprises a first axial end, a second axial end and an opening extending axially along the elastic body between and through the first and second axial ends.

8. The connector according to claim 4, wherein the elastic body of the second terminal comprises an opening extending axially along the elastic body between and through the first and second axial ends.

9. The connector according to claim 7, wherein the width of the opening at the first axial end is greater than the width of the opening at the second axial end.

10. The connector according to claim 8, wherein the opening is substantially V-shaped.

11. A thermocouple comprising:

a phase conductor;

an earth conductor; and a connector for respectively electrically connecting the phase conductor and earth conductor to a phase terminal and an earth terminal of a gas safety valve, the connector comprising an insulating body that electrically isolates a first terminal from a second terminal, the first terminal attached to the phase conductor and attachable to the phase terminal of the gas safety valve, the second terminal attached to the earth conductor and attachable to the earth terminal of the gas safety valve, the insulating body having a housing wherein which the first terminal is at least partially housed, the housing being defined at least in part by one or more flanges that are adapted to expand radially when the first terminal is coupled with the phase terminal of the gas safety valve, extending from a first end of the insulating body are two or more axial openings that at least partially define the one or more flanges, the second terminal comprising an elastic body that at least substantially circumscribes the housing and extends along at least a length of the two or more axial openings, the second terminal configured for being deformed against an inside of the earth terminal of the gas safety valve when the one or more flanges expand radially during the first terminal being coupled with the phase terminal of the gas safety valve.

12. The thermocouple according to claim 11, wherein the elastic body of the second terminal comprises a first axial end and a second axial end, the elastic body being coupled to the insulating body only at one or both of the first and second axial ends.

13. The thermocouple according to claim 12, wherein at least one of the first and second axial ends of the elastic body is disposed within a recess in the insulating body.

14. The thermocouple according to claim 11, wherein the elastic body of the second terminal comprises a first axial end and a second axial end with at least one of the first and second axial ends being disposed within a recess in the insulating body.

15. The thermocouple according to claim 11, wherein the elastic body of the second terminal is barrel-shaped.

16. The thermocouple according to claim 11, wherein the elastic body comprises a plurality of elastic bands that extend between first and second axial ends of the second terminal.

17. The thermocouple according to claim 11, wherein the elastic body of the second terminal comprises a first axial end, a second axial end and an opening extending axially along the elastic body between and through the first and second axial ends.

18. The thermocouple according to claim 14, wherein the elastic body of the second terminal comprises a first axial end, a second axial end and an opening extending axially along the elastic body between and through the first and second axial ends.

19. The thermocouple according to claim 17, wherein the width of the opening at the first axial end is greater than the width of the opening at the second axial end.

20. The thermocouple according to claim 18, wherein the opening is substantially V-shaped.

* * * * *